United States Patent [19]

Keller, Jr. et al.

[11] 4,186,887

[45] Feb. 5, 1980

[54] PROCESSES FOR RECOVERING COAL

[75] Inventors: Douglas V. Keller, Jr., LaFayette; Andrew Rainis, Syracuse, both of N.Y.

[73] Assignee: Otisca Industries, Ltd., Syracuse, N.Y.

[21] Appl. No.: 933,845

[22] Filed: Aug. 15, 1978

[51] Int. Cl.[2] ..... B02C 23/18

[52] U.S. Cl. ..... 241/20; 209/5

[58] Field of Search ..... 209/5, 172; 210/54; 241/15-17, 20, 24; 23/313, 314

[56] References Cited

U.S. PATENT DOCUMENTS

| | | | |
|---|---|---|---|
| 2,744,626 | 5/1956 | Reerink et al. | 209/49 |
| 2,769,537 | 11/1956 | Reerink et al. | 209/49 |
| 2,769,538 | 11/1956 | Reerink et al. | 209/49 |
| 2,781,904 | 2/1957 | Reerink et al. | 209/12 |
| 2,842,319 | 7/1958 | Reerink et al. | 241/14 |
| 2,859,917 | 11/1958 | Reerink et al. | 241/5 |
| 3,045,818 | 7/1962 | Muschenborn et al. | 209/49 |
| 3,268,071 | 8/1966 | Puddington et al. | 209/5 |
| 3,349,909 | 10/1967 | Studer | 209/172 X |
| 3,637,464 | 1/1972 | Walsh et al. | 201/6 |
| 4,033,729 | 7/1977 | Capes et al. | 44/1 A |

FOREIGN PATENT DOCUMENTS

| | | | |
|---|---|---|---|
| 2612441 | 10/1976 | Fed. Rep. of Germany | 209/172 |

OTHER PUBLICATIONS

Brisse et al., Mining Engineering, Feb. 1958, pp. 258-261.

Sastry, K.V.S., Ed. Agglomeration 77, vol. 2, Am. Inst of Mining, Met. & Pet. Engrs, Ing., NY, NY 1977 (Chs 54-56, pp. 910-951).

*Primary Examiner*—Ralph J. Hill

*Attorney, Agent, or Firm*—Le Blanc, Nolan, Shur & Nies

[57] ABSTRACT

Methods of separating solids from mixtures in which they are incorporated by milling the mixture in the presence of a fluorochlorocarbon.

12 Claims, 1 Drawing Figure

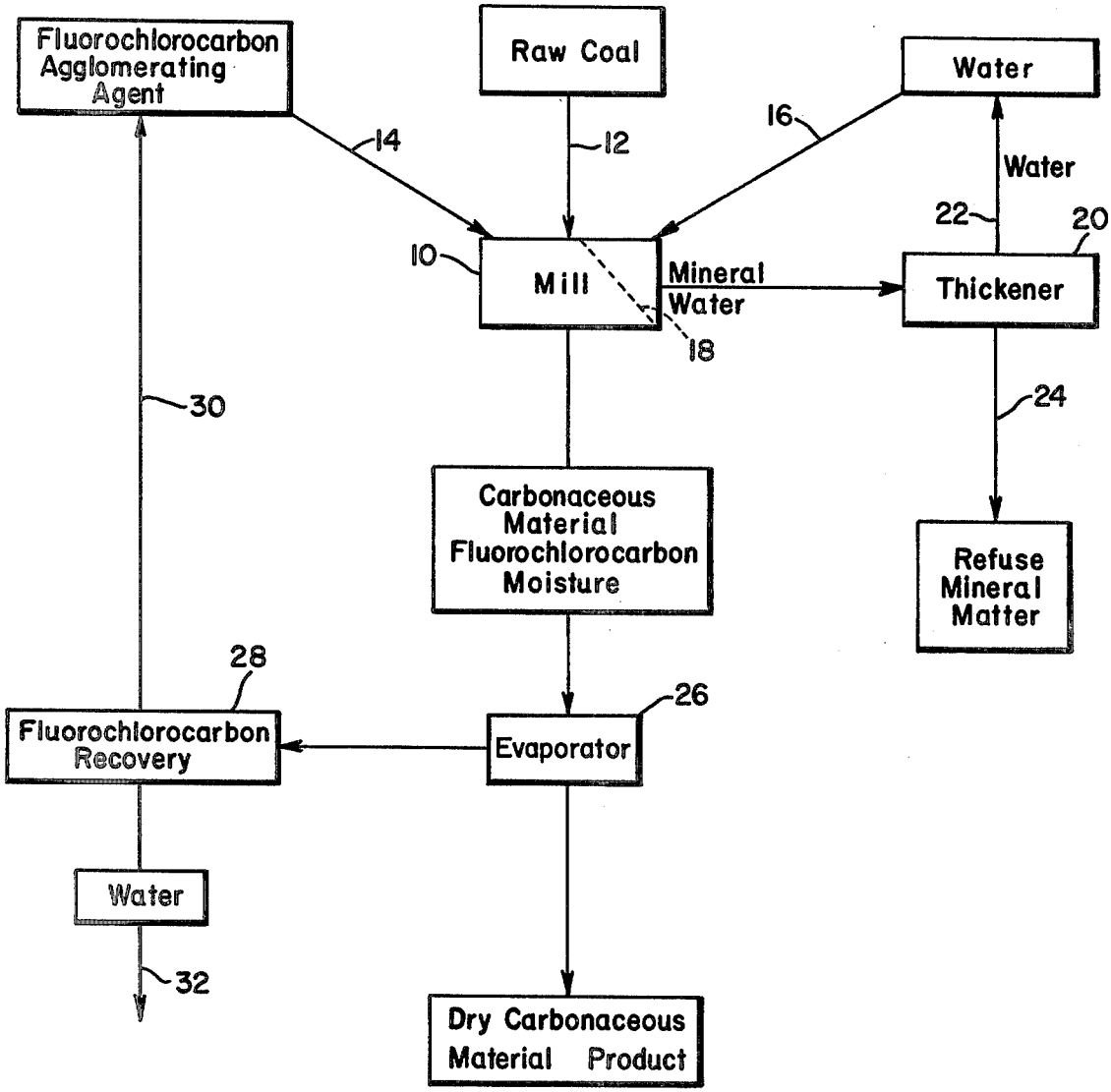
Fluorochlorocarbon Agglomerating Agent
Raw Coal
Water
14
12
16
Water
22
20
10
Mill
Mineral Water
Thickener
18
30
24
Carbonaceous Material Fluorochlorocarbon Moisture
Refuse Mineral Matter
28
26
Fluorochlorocarbon Recovery
Evaporator
Water
32
Dry Carbonaceous Material Product

PROCESSES FOR RECOVERING COAL

The present invention relates to methods for separating particulate solids and, more particularly, to novel, improved methods for recovering finely divided, commercially valuable particles of coal from mixtures in which the coal is associated with other solids.

In some instances, the steps of our novel process, the materials used in carrying it out, and the equipment employed may be as described in pending application Ser. No. 561,168 which was filed Mar. 24, 1975, and which is assigned to the assignee of this application. Application Ser. No. 561,168 is therefore, hereby incorporated by reference herein.

Certain terms used herein are defined as follows:

Raw coal—a composite of coal and mineral matter, a term used herein for the sake of convenience to include impurities other than inorganic material associated with coal. In general raw coal will constitute the feedstock for a process designed to remove at least part of the mineral matter therefrom. The raw coal may be as mined with or without having been subjected to preliminary preparation; or it may be the black water from a hydrobeneficiation plant or the culm from a sludge pond, etc.

Product coal—the carbonaceous coal phase generated in and recovered from a specified cleaning process.

Speaking generally, our novel process includes a raw coal beneficiation phase and a recovery phase.

The beneficiation or cleaning phase involves the steps of: (a) comminuting raw coal in aqueous slurry and in the presence of a fluorochlorocarbon with respect to which the coal is hydrophobic to generate two phases, one composed of particles of mineral matter and the other of particles of coal having freshly exposed surfaces; (b) mechanically forcing the particles of coal together in the slurry and in the presence of the fluorochlorocarbon to agglomerate the particles of coal and to eject water and mineral matter from the agglomerates into the aqueous phase of the slurry; and (c) kneading or working the agglomerates to expel additional mineral matter and water therefrom.

This beneficiation phase of our process produces a product coal phase and an aqueous carrier-mineral matter phase.

The coal phase comprises agglomerates which are hard and dense and therefore quite unlike the loose flocs generated in conventional agglomeration processes. The agglomerates will typically range from pea size to the size of a walnut or larger and can accordingly be easily recovered from the process equipment.

Because it is hydrophilic with respect to the aqueous carrier, the mineral matter remains dispersed in the latter. It, too, can therefore be easily recovered and handled.

The recovery phase of our process follows the beneficiation phase. In the first step of the recovery phase, the product coal agglomerates are removed from the process. The fluorochlorocarbon is then recovered from the agglomerates and recirculated. Water associated with the agglomerates can also be removed. Alternatively, part (or all) of the moisture may be left on the agglomerated coal in applications where this is acceptable to avoid the cost of removing it.

Reduction of mineral matter contents to levels as low as 2 percent or less can be obtained by employing our novel process as just described.

The fluorochlorocarbons we employ are derivatives of methane and ethane. Those derivatives which we consider suitable because of their boiling points (ca. 40°-159° F.) and other physical characteristics (low viscosity, latent heat of vaporization, and surface tension) are:

1-Chloro-2,2,2-trifluoroethane
1,1-Dichloro-2,2,2-trifluoroethane
Dichlorofluoromethane
1-Chloro-2-fluoroethane
1,1,2-Trichloro-1,2,2-trifluoroethane
1,1-Dichloro-1,2,2,2-tetrafluoroethane
Trichlorofluoromethane Mixtures of the foregoing compounds can also be employed.

Of the listed compounds, all but the last three are at the present time probably too expensive to be practical from an economic viewpoint. And, of the latter, 1,1,2-trichloro-1,2,2-trifluoroethane and trichlorofluoromethane are preferred because of their optimum physical properties, chemical activity, and relatively low cost.

A process for recovering coal similar to ours to the extent that coal is separated from associated mineral matter by comminution and agglomeration is disclosed in U.S. Pat. No. 3,268,071 issued Apr. 23, 1966 to Puddington et al. That process, however, differs significantly from ours by its use of nitrobenzene, an aliphatic hydrocarbon solvent, kerosene, lubricating oil, chlorinated biphenyl, or fuel oil to agglomerate the particles of coal generated in the process.

The Puddington et al process is one of several variations of a process developed some 60 years ago and described along with a number of other variations in AGGLOMERATION 77, Vol. 2, K. V. S. Sastry, Ed., American Institute of Mining, Metallurgical & Petroleum Engineers, Inc., New York, New York, 1977, chapters 54–56, pages 910–951.

One important advantage of our novel use of fluorochlorocarbons in the production of low mineral matter content, product coal agglomerates is that they can be recovered in essentially quantitative amounts with modest, commercially viable expenditures of energy. This is important because near quantitative recovery of additives is, generally, a requisite to commerical feasibility in coal cleaning processes of the character with which we are concerned.

In contrast, the heretofore employed agglomerating agents are not recoverable on a basis which is commercially feasible. For example, Capes et al (p. 933, AGGLOMERATION 77) had to employ a temperature of 248° F. at a vacuum of 25 mm of mercury to drive out of agglomerated coal a light diesel oil used as an agglomerating agent. That temperature-pressure combination would, for the most part, be too expensive at the present time to be economically viable in cleaning coal on a commercial scale.

Another important, related difference between our novel processes and those discussed and disclosed in Puddington et al and AGGLOMERATION 77 is that, unlike those identified in that prior art, the novel additives we employ do not form azeotropes with water. This is important because azeotropes can be resolved into their components only at relatively high cost.

The advantage just discussed is particularly significant in those applications where it is not necessary to remove all of the moisture from the agglomerated coal and where processing costs can accordingly be reduced by leaving moisture on the coal. This is not feasible in the prior art processes because the agglomerating agents employed in them do form azeotropes. Those processes consequently necessarily result in the water being removed with the agglomerating agent, and the azeotrope must then be resolved to recover the agglomerating agent, a relatively expensive procedure as indicated above. In our novel process, in contrast, the fluorochlorocarbon additive can be recovered mechanically and inexpensively, leaving the water behind.

Another advantage of our novel additives is that, because they evaporate so rapidly, the partial pressure of the water associated therewith is substantially lowered in the course of recovering the additive from the coal. This permits the water to be efficiently codistilled with the additive (that is, evaporated at a temperature approximating the boiling point of the additive rather than at 212° F.), if desired. This produces a substantial reduction in the cost of removing the water because the energy input to the system employed to evaporate the water is significantly reduced.

Yet another advantage of our novel additives is that, unlike the agglomerating agents disclosed in Puddington et al, AGGLOMERATION 77, and elsewhere in the prior art, they do not react chemically with coal. This is important because contaminated coals are undesirable. In the case of steaming coals chemical contaminants can cause boiler corrosion. Contaminated coking coals can undesirably alter the chemistry of the reactions in which they are typically employed.

Other advantages of our novel additives are that they are non-flammable, odor free, non-corrosive, and nontoxic. These are important for obvious reasons.

Yet another advantage of our process over that described in AGGLOMERATION 77 and discussed above is that the agglomerates we obtain are more easily handled and therefore much more useful than the fragile, floc-like aggomerates typically obtained in the prior art process.

From the foregoing, it will be apparent to the reader that the primary object of the present invention resides in the provision of novel, improved methods for separating coal from mineral matter associated therewith.

Other important but more specific objects of the invention reside in the provision of processes in accord with the preceding object in which the coal is recovered in agglomerated form, in which a fluorochlorocarbon additive is employed and in which:

the additive can be recovered from the agglomerates in essentially quantitative amounts with relatively modest expenditures of energy;

the additive does not form an azeotrope with water to any commercially significant extent, if at all, and can accordingly be recovered without the necessity of removing large quantities of moisture from the agglomerates;

the additive is capable of effecting a codistillation of moisture associated with the coal, thereby reducing the cost of removing the moisture from the coal;

the additive does not react chemically with the coal to any significant extent;

the additive is not corrosive, flammable or toxic;

the additive is fluorochloro derivative of methane or ethane;

the agglomerates of product coal which the process produces are hard, dense, and strong and therefore easily handled.

Other important objects, features, and advantages of the invention will be apparent from the appended claims and from the ensuing detailed description and discussion of the invention as it proceeds in conjunction with the accompanying drawing which is a flow diagram of a coal recovery process in accord with and embodying the principles of the present invention.

Referring now to the drawing, the separation of coal from the mineral matter associated therewith and the subsequent agglomeration of the coal particles and the ejection of mineral matter and water from the agglomerates is carried out in a mill 10 which may be, for example: a ball, beater, buhr, cage, Chilean, colloid, disc, disintegrating, hammer, pebble, pendulum, pin, Raymond, or rod mill.

The separation may be carried out at ambient temperature and pressure.

Mill 10 reduces the size of the material fed to it, thereby liberating the product coal from the mineral matter to which it is bound and exposing fresh surfaces on the coal particles. The mill also provides the mechanical forces which jam the coal particles into agglomerates of the wanted character and which eject the mineral matter and water from the agglomerates. In addition it generates the forces which knead or work the agglomerates to expel additional mineral matter and water therefrom.

Raw coal (i.e., the coal to be cleaned) and a fluorochlorocarbon additive are introduced into the mill through transfer devices indicated generally by reference characters 12 and 14. Such water as may be necessary is introduced into mill 10 through conduit 16.

The minimum amount of additive is that necessary for an efficient agglomeration of the particles of product coal to be effected. Three percent by volume of the additive based on the volume of the liquid carrier—raw coal—additive system we employ is necessary for that purpose.

The ratio of additive to coal is maintained in the range of 0.1 to 0.5 by volume with a ratio around 0.3 being preferred. At lower ratios the amount of fluorochlorocarbon is not sufficient to effect the wanted, complete agglomeration of the product coal; at ratios higher than that specified, efficient rejection of the particles of mineral matter is not effected because the excess additive forms a film through which substantial amounts of the particles may not have sufficient energy to escape.

We consider it essential that a minimum of fifty (50) percent of water based on the volume of the raw coal-additive-liquid system be maintained in mill 10. Lower amounts do not provide a sufficiently large body of liquid to hold the mineral matter in suspension, which is a requisite of our process. Often, the moisture associated with the raw coal will itself meet this minimum requirement in which case it may not be necessary to introduce additional water; e.g., in pumping the raw, feedstock coal to the process from a slurry pond.

The maximum amount of water and fluorochlorocarbon additive that can be tolerated in mill 10 is that at which the comminution of the solids in the mill becomes inefficient. Depending upon the type of mill being employed, up to 95 percent of water and additive combined may be employed based upon the volume of the raw coal.

One typical charge we have successfully employed consists of 9% by volume raw coal, 4% by volume 1,1,2-trichloro-1,2,2-trifluoroethane and 87% by volume water, again based on the volume of the carrier liquid-raw coal-additive system.

The residence time in the mill is that necessary to effect a sufficient reduction in particle size to separate the raw coal into particles of product coal with freshly exposed surfaces and mineral matter and a subsequent agglomeration of the product coal. Efficient separation of the coal from the associated ash requires that the raw coal be reduced to a top size of ca. 50 microns. In a ball mill this will typically require a grinding time of about two hours for a representative coal. By employing other types of mills this time can be cut to minutes, although this may be at the expense of higher expenditures of energy, a reduction in the permissible concentration of solids, and/or other trade-offs that may decrease the significance of the reduction in process time.

We prefer that the water be changed after grinding periods of 15–45 minutes or that a discharge of refuse laden water and concomitant replacement of that phase with fresh water be effected in accord with conventional milling practice. If the latter approach is employed, a supply and discharge rate approximating 100–120% per hour based on the volume of the aqueous carrier will typically be employed where optimum separation of mineral matter is wanted as this results in a maximum reduction of mineral matter content. Where less than optimum separation of mineral matter is acceptable, this rate can be reduced.

The aqueous carrier and mineral matter are discharged from mill 10 through a screen 18 on which the agglomerates of coal are retained. This aqueous phase is transferred to a conventional thickener 20 as described, for example, in Taggart, HANDBOOK OF MINERAL DRESSING, John Wiley & Sons, Inc., New York, New York, 1927, pp. 15-04–15-26, hereby incorporated herein by reference. Here the mineral matter is separated. The water may be recycled as indicated by arrow 22, and the mineral matter may be transferred to a refuse heap as indicated by arrow 24.

Traces of the fluorochlorocarbon additive may be carried from the slurry with the mineral matter laden, aqueous phase in both the batch- and continuous-type techniques for replacing that phase with fresh aqueous liquid. The additive can be easily recovered in a conventional absorber in circumstances where recovery is economically justified.

We consider it important that the raw coal be free of large proportions of ultrafines. The agglomeration of the product coal particles in our novel process involves surface active phenomena which operate efficiently only on freshly exposed coal particle surfaces. As the chemistry of coal surfaces changes rapidly even in ambient temperature, this means that those surfaces must be generated in the controlled environment of the mill. The fracturing of the coal particles to the extent necessary to generate adequate fresh surfaces cannot be accomplished with even prolonged periods of milling if large amounts of ultrafine coal particles are present in the raw coal.

This requirement that only a limited proportion of ultrafine particles be present in the feedstock dictates that the raw coal supplied to mill 10 have a minimum top size of about 60×0 mesh Tyler (0.25 mm×0).

Following the liberation of the mineral matter and agglomeration of the product coal, the product coal agglomerates with their accompanying burdens of fluorochlorocarbon additive and moisture are transferred to an evaporator 26 where at least the additive is stripped from the agglomerates. Moisture associated therewith may also be stripped from the coal in evaporator 26. However, as discussed above, it is not in every case necessary that all, or even any, of this moisture be removed; and it is an important feature of our invention that an essentially quantitative (99% plus) recovery of additive can be made without removing the water.

Suitable evaporators are described in application Ser. No. 561,168.

Any aqueous phase is treated as described above.

As indicated above, it is one of the important features of the present invention that evaporation of the fluorochlorocarbon additive as just described can be effected at a fast enough rate to substantially reduce the vapor pressure over, and, as a consequence, the cost of recovering the moisture from the coal. This was demonstrated by evaporating 15% by weight of trichlorofluoromethane from a bed of fine coal containing 6% by weight moisture at a temperature only 6° C. above the 24° C. (75° F.) boiling point of that compound. In less than 10 minutes the moisture content of the coal had been reduced by ca. 2%. At the same temperature it would have taken several hours for the coal to have lost that much moisture absent the codistillation effected by the fluorochlorocarbon.

Other of the additives we employ, notably 1,1,2-trichloro-1,2,2-trifluoroethane, exhibit this novel codistillation capability to an even greater, and therefore more beneficial, extent.

Mechanical removal of liquid can be employed in association with evaporator 26 to reduce the load on and cost of operating the latter in those instances where the moisture content of the coal is high enough to warrant. Simply by passing a typical agglomerate through the nip between two conventional wringer rolls, for example, the moisture content of the agglomerate can be reduced to on the order of 20% by weight. In general, however, mechanical dewatering will not be employed as the moisture content of the agglomerates typically does not exceed 10–25 percent.

The fluorochlorocarbon and any moisture recovered from the evaporator therewith are transferred to a fluorochlorocarbon recovery unit 28 of the type described in application Ser. No. 561,168, for example. The water and additive are co-condensed and can then be readily separated due to their virtually complete immiscibility.

The fluorochlorocarbon additive is recycled as shown by arrow 30, and the water (arrow 32) may also be recycled.

The examples which follow describe representative tests which illustrate various facets of our novel coal cleaning processes.

EXAMPLE I

The viability of our process was demonstrated in tests in which one liter of water was mixed with one hundred grams of 30 mesh×0 raw coal and thirty milliliters of 1,1,2-trichloro-1,2,2-trifluoroethane in a jar mill containing burundum grinding media having a 2 cm outer diameter. The system was sealed and rotated for a period of one hour.

At this point the agglomerated coal found in the mill was separated from the water-mineral matter (or ash) phase by passing the entire mix through a 5 mesh sieve. The coal agglomerates were returned to the mill with clean water and the cycle repeated until the water phase existing after milling was essentially free of mineral matter.

The resulting agglomerates of clean coal were between 0.5 and 3 cms in diameter. The agglomerates were dried and submitted to chemical analysis.

To provide a basis for comparison, raw coal of the same origin was cleaned using the bench test, gravity separation procedure described in application Ser. No. 561,168 with trichlorofluoromethane being employed as the parting liquid.

The coal used in the test, Meigs No. 9, Central Ohio, is known to be very difficult to clean.

Data obtained from representative tests is tabulated below. All data is on a dry basis.

TABLE I

| | A Raw Coal | B Product Coal | C Product Coal | D Product Coal | E Product Coal |
|---|---|---|---|---|---|
| Size Consist | — | ⅜" × 0 | 30m × 0 | 60m × 0 | 400m × 0[2] |
| Percentage of Ash | 23.8 | 11.5 | 9.5 | 8.08 | 6.87 |
| Lbs of Ash/$10^6$BTU | 21.5 | 9.1 | 7.58 | 6.13 | 5.14 |
| Percent Reduction in Ash[1] | — | 68 | 83.7 | 83.9 | 80.5 |
| BTU/lb | 10,750 | 12,680 | 12,869 | 13,173 | 13,172 |
| BTU/Yield (%) | — | 78 | 51.3 | 50.2 | 99 |
| Weight Yield | — | 66 | 42.0 | 42.3 | 79.3 |

[1]Based on weight of raw coal
[2]Particle size of the product coal making up the agglomerates
B,C,D -- cleaned by the gravity separation control process described above and in application no. 561,168
E -- cleaned using the process of the present invention described above and 1,1,2-trichloro-1,2,2-trifluoroethane as the fluorochlorcarbon additive. Virtually all of the mineral matter remaining is iron pyrite ash which can be separated by a subsequent process step or steps, if necessary.

The tabulated data clearly demonstrate the efficacy of the novel coal cleaning process described herein.

For example, the state-of-the-art process (results tabulated in Columns B–D) is capable of reducing the mineral matter content of many coals to levels lower than those indicated to be theoretically possible by the method of washability analysis currently employed by industry. Yet the coal produced by our novel process had a lower mineral matter content (15% on a weight basis and 16% on a BTU basis). And, strikingly, and most important from the production cost viewpoint, the BTU yield was 97 percent higher.

EXAMPLE II

To provide a different basis for comparison, the procedure described in Example I was repeated on the Meigs No. 9 coal using No. 6 fuel oil as an agglomerating agent. The initial mixture charged to the jar mill contained, by volume:

No. 6 fuel oil: 2.4 percent
Coal: 16.3 percent
Water: Balance

The system was examined after one hour of grinding. No agglomeration appeared to have taken place.

Additional oil was accordingly added, giving a mixture containing:

No. 6 fuel oil: 4.8 percent
Coal (from the first hour of grinding): 16.3 percent
Water: Balance Grinding was continued for four additional hours with the water being changed twice during that period.

At the end of the four hour period a coal and oil phase was found smeared over the inside of the jar mill rather than existing as individual agglomerates which could be readily separated from the liquid phase like the product coal generated in accord with the present invention in the test described in Example I.

The coal and oil phase could be removed only by the use of a solvent. This procedure was employed so that the coal could be recovered and subjected to analysis. The analysis showed that the product coal had an ash content of 15.90 percent in comparison to the 6.8% ash content of the product coal generated by our process (Column E, Table 1).

EXAMPLE III

To show that other fluorochlorocarbons can be used in our novel process the jar mill procedure described in Example I was repeated, using trichlorofluoromethane. While the results were not quantified, the appearance and character of the product coal agglomerates which were obtained and of the aqueous carrier residue phase were quite similar to what resulted from the test described in Example I.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. A process for dissociating coal from a composite in which mineral matter is associated therewith and recovering said coal in agglomerated form, said process comprising the steps of: forming an aqueous slurry containing said composite and a fluorochlorocarbon with respect to which said coal is hydrophobic; milling said composite until the composite has been resolved into particles of mineral matter and particles of coal and the latter have been coalesced into agglomerates of product coal; and recovering the agglomerates from the slurry.

2. A process as defined in claim 1 wherein the fluorochlorocarbon is a derivative of methane or ethane selected from the group consisting of:

dichlorofluoromethane
trichlorofluoromethane
1,1,2,2-tetrachloro-1,2-difluoroethane
1,1,2-trichloro-1,2,2-trifluoroethane
1,1-dichloro-1,2,2,2-tetrafluoroethane
1-chloro-2,2,2-trifluoroethane
1,1-dichloro-2,2,2-trifluoroethane 1-chloro-2-fluoroethane
and mixtures of the foregoing.

3. A process as defined in claim 1 which includes the steps of stripping the fluorochlorocarbon from the agglomerated coal particles and then recovering and recycling said fluorochlorocarbon.

4. A process as defined in claim 3 in which the agglomerates are dewatered concomitantly with the stripping of the fluorochlorocarbon therefrom at a temperature which is below the boiling point of water at a pressure of one atmpsphere.

5. A method as defined in claim 1 in which is carried out at ambient temperature and pressure.

6. A process as defined in claim 1 in which the water and fluorochlorocarbon respectively constitute at least fifty and three percent by volume of the slurry and wherein said water and fluorochlorocarbon together do not constitute more than 95 percent by volume of said slurry.

7. A process as defined in claim 1 in which the ratio of fluorochlorocarbon to coal-mineral matter composite is maintained at 0.1 to 0.5 by volume.

8. A process for dissociating coal from a composite in which mineral matter is associated therewith and recovering said coal in agglomerated form, said process comprising the steps of: forming a slurry of said composite in an aqueous carrier with respect to which said mineral matter is hydrophilic; providing a fluorochlorocarbon with respect to which said coal particles are hydrophobic in said slurry in an amount sufficient that agglomeration of the coal can be effected; comminuting the particles of composite while in said slurry to separate the mineral matter from the coal and to generate coal particles having freshly exposed surfaces in a controlled environment; mechanically effecting the coalescence of the coal particles into product coal agglomerates and the ejection of mineral matter and water from the agglomerates into dispersion in said aqueous carrier; and recovering said product coal agglomerates from said slurry.

9. A process as defined in claim 8 together with the steps of removing the mineral matter from the carrier liquid-mineral matter phase and then reusing said liquid.

10. A process as defined in claim 8 in which the coal and mineral matter are comminuted to a size of 200 mesh×0 or less.

11. A process as defined in claim 8 in which, at least once during the course of the process cycle, the aqueous liquid-mineral matter phase is removed and replaced with fresh aqueous liquid.

12. A process as defined in claim 8 in which carrier burdened with mineral matter is continuously removed from the slurry and replaced with fresh aqueous liquid.

* * * * *